US006971920B2

(12) United States Patent
Crupi

(10) Patent No.: US 6,971,920 B2
(45) Date of Patent: Dec. 6, 2005

(54) ELECTRICAL MULTIPLE OUTLET DEVICE AND ELECTRICAL DEVICE HAVING PIVOTABLE ELECTRICAL PRONGS

(76) Inventor: Theodore P. Crupi, P.O. Box 140117, Staten Island, NY (US) 10314

( * ) Notice: Subject to any disclaimer, the term of this patent is extended or adjusted under 35 U.S.C. 154(b) by 0 days.

(21) Appl. No.: 10/831,810

(22) Filed: Apr. 26, 2004

(65) Prior Publication Data

US 2005/0239336 A1 Oct. 27, 2005

(51) Int. Cl.[7] ..... H01R 25/00

(52) U.S. Cl. ..... 439/654; 439/954; 439/172; 439/136; 439/640; 439/652

(58) Field of Search ..... 439/131, 650, 439/651, 652, 653, 654, 501, 535, 640, 954, 439/172

(56) References Cited

U.S. PATENT DOCUMENTS 2,792,561 A 5/1957 Cohen
3,997,225 A * 12/1976 Horwinski ..... 439/652
5,350,310 A * 9/1994 Chen ..... 439/188
5,791,921 A * 8/1998 Lee ..... 439/172
5,967,807 A * 10/1999 Wu ..... 439/131
6,113,434 A * 9/2000 Pate ..... 439/652
6,126,460 A * 10/2000 Wu ..... 439/131
6,315,593 B1 11/2001 Bentley et al.
6,315,617 B1 * 11/2001 Al-Sabah ..... 439/652
6,386,921 B1 5/2002 Casari
6,443,772 B1 * 9/2002 Chen ..... 439/652
6,483,028 B2 * 11/2002 DeBartolo et al. ..... 174/48
6,515,239 B2 2/2003 Marchant
6,533,598 B1 3/2003 Bentley et al.
6,793,509 B2 * 9/2004 Chen ..... 439/136

* cited by examiner

*Primary Examiner*—Briggitte R. Hammond
(74) *Attorney, Agent, or Firm*—Ostrolenk, Faber, Gerb & Soffen, LLP

(57) ABSTRACT

A multi-receptacle device having a housing with a front face, a back face, an end face and a plurality of receptacles in the front face. A first set of prongs and a second set of prongs are pivotally mounted in the housing so as to be movable between a first position in which the prongs project from the back face of the housing and a second position in which the prongs are about 90° to the prongs in the first position.

28 Claims, 6 Drawing Sheets

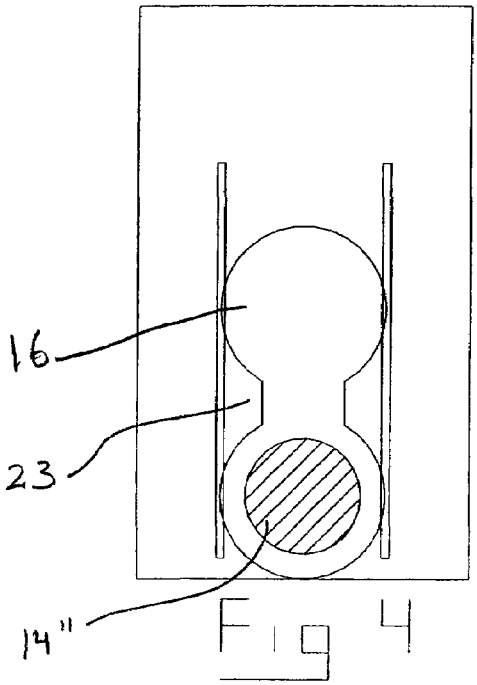
Fig 4
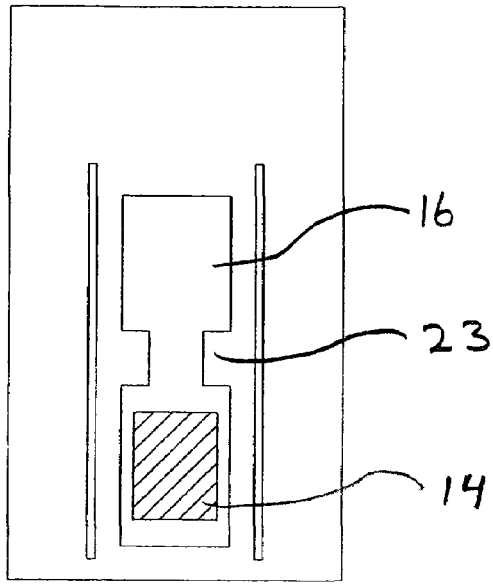
Fig 5
Fig 6
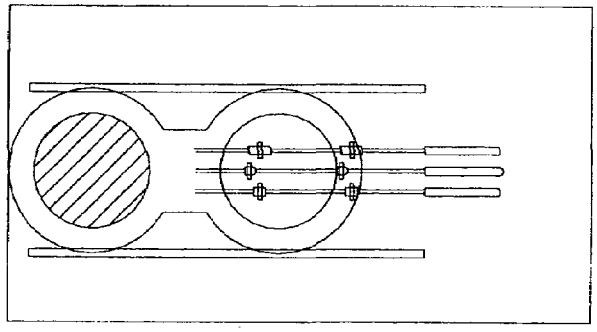

ELECTRICAL MULTIPLE OUTLET DEVICE AND ELECTRICAL DEVICE HAVING PIVOTABLE ELECTRICAL PRONGS

BACKGROUND OF THE INVENTION

The present invention relates generally to the field of electrical plug adapters, and more particularly to an adapter that can be used in a wall outlet and an extension cord to provide additional receptacles.

Many types of devices are known which increase the number of electrical receptacles in a conventional two receptacle wall outlet. Such prior art devices include power strips or surge protectors which are essentially a housing having a number of outlets therein. An electrical cable extends from the housing and has a plug for insertion in the wall outlet. Another type of known device is a housing that has two sets of prongs that plug simultaneously into both receptacles of the wall outlet so that the housing is mounted on the wall. The housing in turn has a number of receptacles so that more than two plugs can be used in the wall outlet. Such a device is taught, for example, by U.S. Pat. No. 2,792,561. Another device for increasing the number of receptacles is taught by U.S. Pat. No. 6,315,593.

The problem with these prior art devices is that they are each suitable for only a single type of application. For example, the devices of U.S. Pat. Nos. 2,792,561 and 6,315,593 can only be mounted to a wall outlet for use. In other words, they are not suitable nor intended for connection to an extension cord so that the assembly can be safely used away from the wall outlet to provide additional receptacles. In a similar fashion, conventional power strips as described previously are connected to electrical cables of various length and, thus, are not able to be mounted directly to the wall outlet. This results in the problem that it is often necessary to have both types of devices available. Also, it may be necessary to purchase a different device if the location of the electrical equipment to be plugged into the receptacles is moved so that, for example, the outlet mounted receptacle is no longer practical and an extension cord is needed.

SUMMARY OF THE INVENTION

Accordingly, it is an object of the present invention to address this problem with the prior art by providing a receptacle multiplier device that can be safely used either directly at the wall outlet or with an extension cord.

Pursuant to this object, one aspect of the present invention resides in a multiple outlet device that has a housing with a plurality of sets of receptacles, each set including either two laterally spaced plug apertures or two laterally spaced plug apertures and a round ground prong aperture. These receptacle aperture configurations are conventional and known in the art. The receptacle apertures can be provided at any desired position in the housing. In a first embodiment, the receptacles are provided in a front surface of the housing and arranged in three rows. In the central row the receptacles are arranged one above the other. In the two side rows the receptacles are rotated to 90° so that the receptacles are side by side. The receptacles can be spaced so as to accommodate both electrical transformers and electrical plugs. Transformers, as is known in the art, are normally made up of a rectangular square housing and are needed for converting AC voltage to DC voltage to power, for example, power tools, flash lights, computer monitors, printers, etc.

On the back side of the housing are provided, in the preferred embodiment, two sets of prongs for insertion into a wall outlet. However, the insert can be implemented with only one set of prongs on the backside. Two sets of prongs, as shown, allow the receptacle to be plugged into a dual wall receptacle, for increased securement to the wall receptacle. Each set includes blade prongs and a ground prong. It is understood that it is also possible to provide only two blade prongs. The prongs are pivotably mounted within the housing. The back surface of the housing has elongate slots through which the prongs pass. The prongs are attached to one another by a first arm and to a slide member by a second arm. The slide member is accessible on the back side of the housing so that by sliding the slide member the prongs can be pivoted to be completely within the housing or to project from the housing for insertion into the wall outlet. The slide member locks in two end positions, one position corresponding to the prongs being within the housing and the other corresponding to the prongs extending from the back side of the housing.

A third set of prongs is connected to the pivotable prongs by a third arm. The third set of prongs is slidably arranged within the housing so as to be movable between a first position in which the third set of prongs is completely within the housing and a second position in which the prongs extend from an end side of the housing.

The three sets of prongs are connected together by the first and third arms so that when the third set of prongs is in the first position completely within the housing, the other sets of prongs project from the back of the housing for insertion in a wall outlet. However, when the slide member is moved to pivot the first and second sets of prongs back into the housing, the third set of prongs is simultaneously pushed out the end side of the housing so that the device can be plugged into an extension cord. As mentioned previously, the slide member locks in both of these end positions to maintain the prongs in their positions.

With the present invention it is thus possible, with a single device, to provide multiple receptacles either directly at the wall outlet or at the end of an extension cord in a safe and inexpensive fashion.

For a more complete understanding of the electrical multiple outlet device of the present invention, reference is made to the following detailed description and accompanying drawings in which the presently preferred embodiments of the invention are illustrated by way of example. That the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

BRIEF DESCRIPTION OF THE DRAWINGS

FIG. 4 is a top view of a first embodiment of the slider;

FIG. 5 is a view as in FIG. 4 of a second embodiment of the slider;

FIG. 6 is a view as in FIG. 4 showing connection of the prongs to the slider;

DETAILED DESCRIPTION OF THE INVENTION

Figure 1:
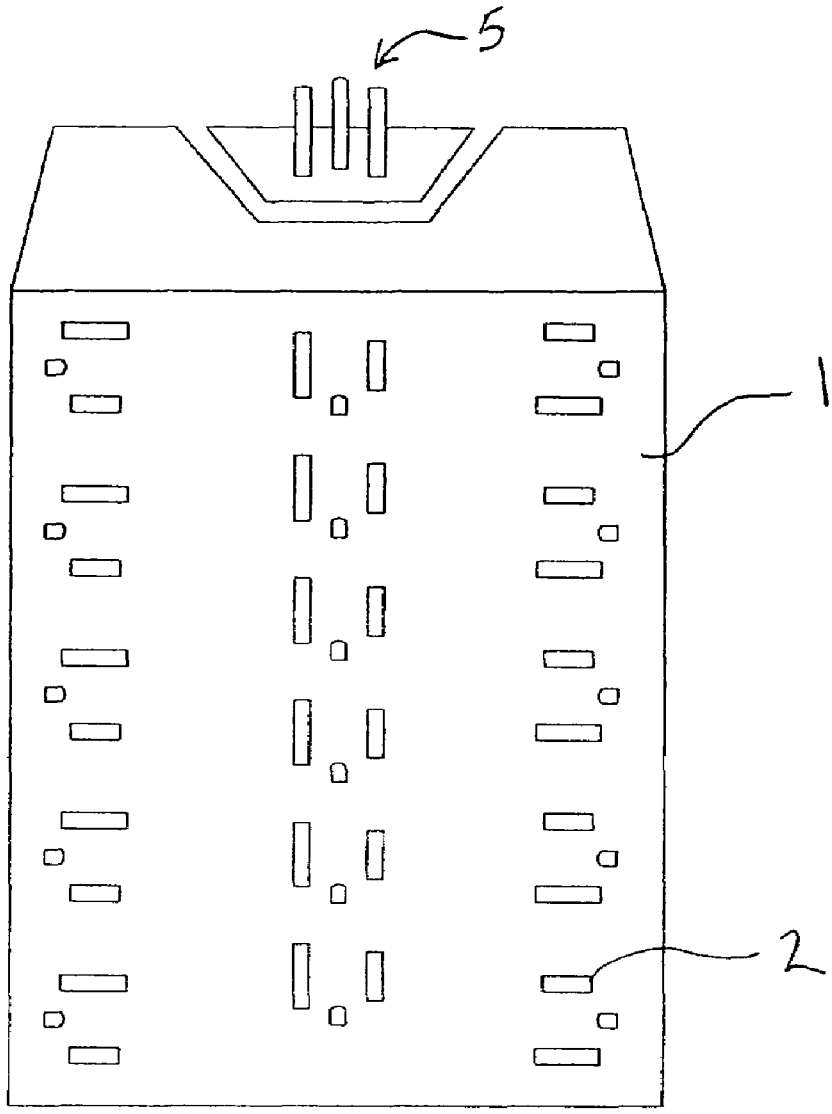
FIG. 1 is a front perspective view of the inventive device.

As can be seen in FIG. 1, the inventive device includes a housing 1 with a plurality of receptacles 2. In the illustrated embodiment, the receptacles each include openings for a conventional three-prong plug. Again in the illustrated embodiment, the receptacles are arranged in three columns with the center column having the receptacles arranged one above the other and the side columns having the receptacles arranged at 90° to the center column with the ground prong opening closest the outer edge of the housing. The receptacles in the side columns are spaced so as to accommodate transformers. It is understood that the receptacles can be arranged in any desired manner and can also be for two-prong plugs.

Figure 2:
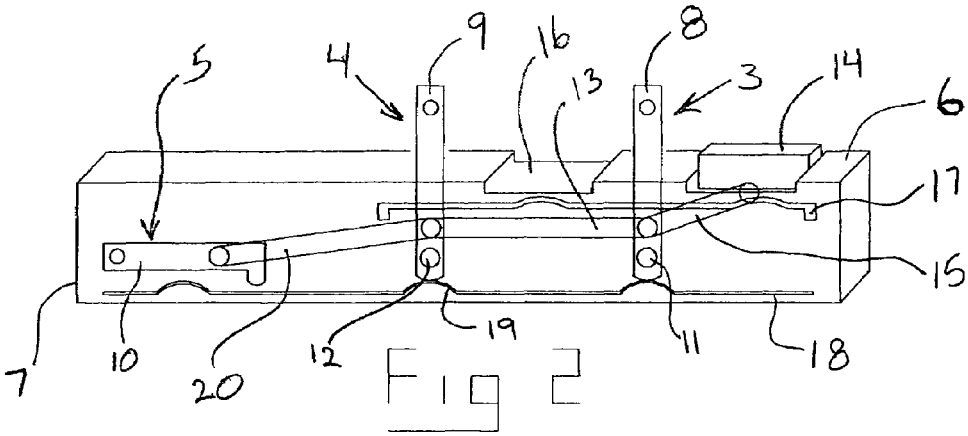
FIG. 2 is a cross-section through FIG. 1.

FIG. 2 shows the interconnection of the three sets of prongs which are provided in the housing. Only one prong from each set is shown from FIG. 2 that is representative of the other prongs of the set as well. A first set of prongs 3 and a second set of prongs 4 extend from the back side 6 of the housing 1 and a third set of prongs 5 is arranged to be extendible from an end face 7 of the housing. A respective prong of each of the sets of prongs is connected to the corresponding prong of the other sets. As can be seen in FIG. 2, the prong 8 of the first set of prongs 3 is connected to the prong 9 of the second set of prongs 4, which in turn is connected to a prong 10 of the third set of prongs 5. The prongs 8, 9 are pivotably mounted in the housing 1 at pivot points 11, 12, respectively.

Figure 7:
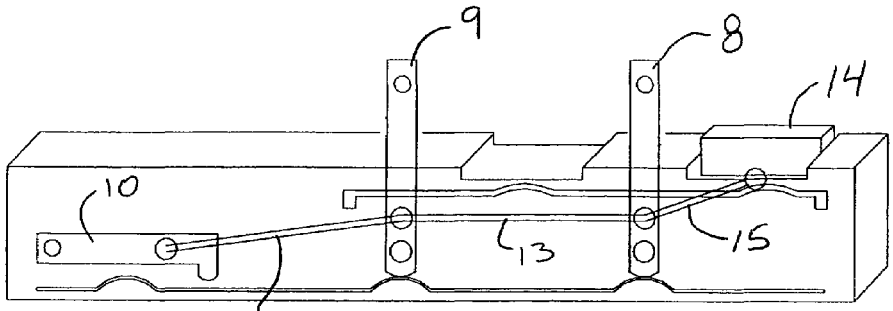
FIG. 7 shows the device in a first operative position.
Figure 8:
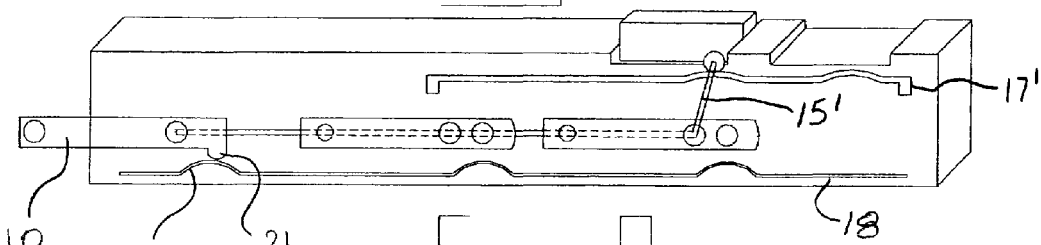
FIG. 8 is a view as in FIG. 7 of the device in a second operative position.

The prongs 8, 9 can be pivoted between a first position as shown in FIG. 7 in which the prongs 8, 9 extend from the back side 6 of the housing and a second position as shown in FIG. 8 in which the prongs 8, 9 are completely within the housing 1. The prongs 8, 9 are connected together by a first non-conductive arm or link 13 so that both the prongs 8, 9 move together. A slide member 14 is connected to the first prong 8 by a second non-conductive arm or link 15. Movement of the slide member is transmitted to the prongs 8, 9 by the arms 15, 13. The slide member 14 is shown in FIG. 2 as a button that can be depressed to unlock the end position in which the prongs 8, 9 project from the back surface of the housing and then pushed forward into the opening 16 in which the slide member 14 once again locks in place in the position shown in FIG. 8. This locking of the slide member in place is accomplished by a spring or tension element 17 that pushes against the slide member 14 in the two end positions.

A conductor element 18 is provided adjacent the front wall of the housing 1 to provide electrical contact in the receptacles in the front face. Each conductor has two curved portions 19 that engage the inner ends of the prongs 8, 9, respectively when the prongs 8, 9 are in the position in which they project from the back of the housing. When the prongs 8, 9 are pivoted back into the housing as shown in FIG. 8, they disconnect from the curved portions 19 of the conductor 18.

The prong 10 of the third set of prongs 5 is connected to the prong 9 of the second set of prongs 4 by a third non-conductive arm or link 20. The prong 10 is slidable between an inoperative position in which the prong 10 is completely within the housing and an operative position in which the prong 10 projects from the end face 7 of the housing as shown in FIG. 8. The prong 10 is movable between the two positions by actuation of the slide member 14. As the slide member 14 is moved from the position shown in FIG. 7 into the position shown in FIG. 8, the arm 15 pivots the prong 8, which in turn pushes the arm 13, which pivots the prong 9, which pushes the arm 20, which in turn pushes the prong 10 out of the housing. The prong 10 has a nub 21 that engages a curved portion 22 of the conductor 18 when the prong 10 projects from the housing so that the prong 10 is in electrical connection with the conductor 18.

As can be seen in the attached drawings and from the description provided above, the device can be safely used with either a wall outlet or an extension cord to provide additional receptacles.

Figure 3:
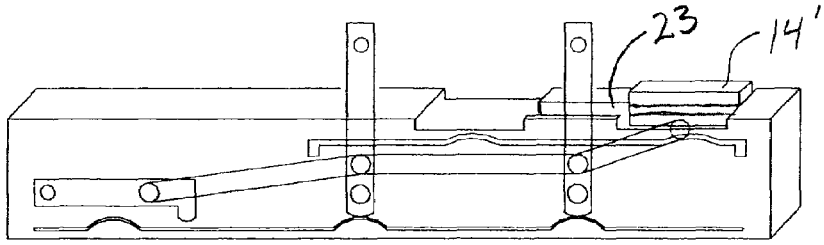
FIG. 3 is a view as in FIG. 2 of another embodiment of the invention.

FIG. 2 shows an embodiment in which the slide member 14 is depressed completely into the housing to move between the two end positions. FIG. 3 shows an embodiment in which the slide member 14' slides from the first position to the second position via a channel 23 in the back surface 6 of the housing between the two end positions.

FIG. 4 schematically shows a round slide member 14" and FIG. 5 shows a rectangular slide member 14. In order to move the slide member, it is depressed with the user's thumb and then pushed beneath the projections 23 into the opening 16. Upon reaching the opening 16, the slide member is forced upwardly by the spring element 17 to lock it into position. Rather than projections 23, the entire region between the two end positions of the slide member can be covered by the back surface of the housing as shown in FIG. 2.

FIG. 6 schematically shows the connecting arms or links for the three prongs. Each prong of a set of prongs is respectively connected to a corresponding prong of the other sets of prongs.

In addition to showing the position in which the prong 10 projects from the end wall of the housing, FIG. 8 also shows an embodiment in which the slide element has a shorter travel length than in FIG. 7. In this embodiment, the arm 15' is shorter and the spring element 17' is configured in a slightly different manner to facilitate the shorter travel path of the slide member 14. In all other respects, however, the embodiment of FIG. 8 is the same as that of FIGS. 2 and 7.

Figure 9:
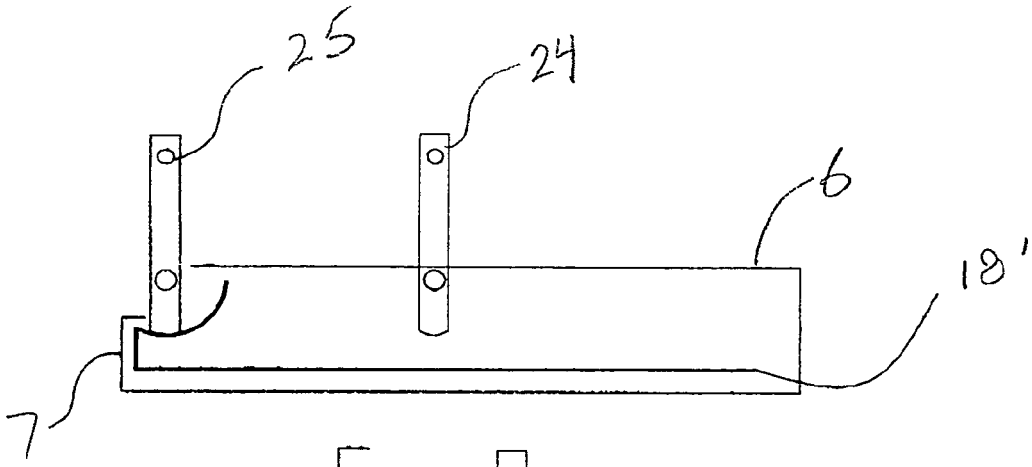
FIG. 9 is a view of another embodiment in a first operative position.
Figure 10:
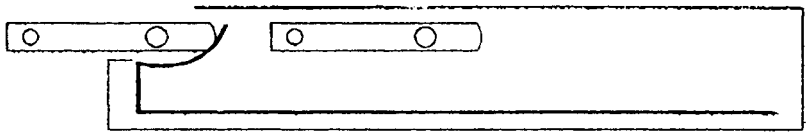
FIG. 10 is a view as in FIG. 8 of the device in a second operative position.

FIGS. 9 and 10 show an alternative construction of the invention in which only two sets of prongs are necessary. In this embodiment, a first set of prongs 24 is pivotally arranged in the housing at a distance from the ends of the housing. This set of prongs 24 is not connected to nor connectable with the conductor 18'. Therefore, the set of prongs 24 acts only as a support for mounting the device to a wall outlet. A second set of prongs 25 is pivotally arranged in a corner region of the housing when seen in cross-section so that the set of prongs 25 is pivotable between a first position in which the prongs project from the back side 6 of the housing into a second position in which the set of prongs 25 project from the end face 7 of the housing, as shown in FIG. 10. The conductor 18' is configured to continually be in contact with the inner end of the prongs 25 in both positions. Thus, in this embodiment, only two sets of prongs are needed for providing a device which can be used both in a wall outlet and an extension cord to provide multiple receptacles. Furthermore, in this embodiment only one set of prongs is actually used for conducting electricity.

Figure 11:
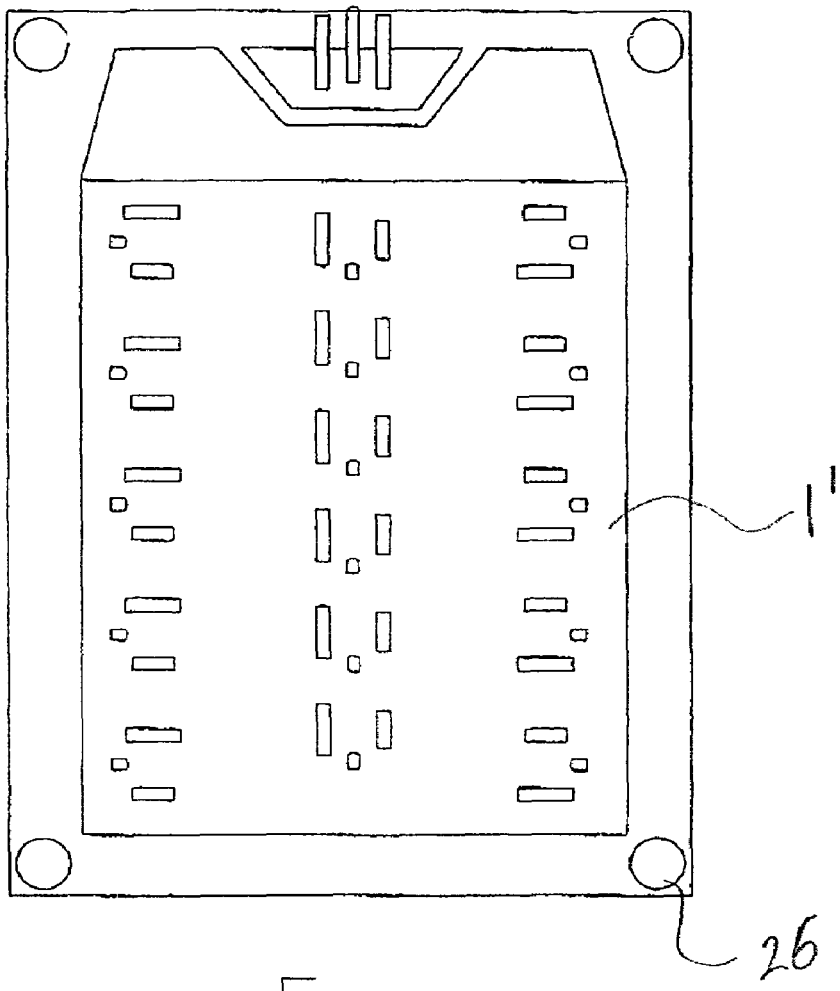
FIG. 11 is a view as in FIG. 1 of yet another embodiment.

In FIG. 11, an embodiment is shown which has a housing 1' provided with mounting holes 26 that allow the inventive device to be mounted to a vertical surface.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A multi-receptacle device, comprising:

a housing having a front face, a back face, an end face and a plurality of receptacles in the front face;

a first set of electrical prongs; and wherein the first set of prongs is pivotally mounted in the housing so as to be movable between a first position in which the prongs project from the back face of the housing and a second position in which the prongs are about 90° to the prongs in the first position, further comprising a second set of prongs, the second set of prongs being pivotally mounted in the housing so as to be movable between a first position in which the prongs project from the back face of the housing and a second position in which the prongs are about 90° to the prongs in the first position, the first and second sets of prongs being pivotable about different axes of rotation.

2. A multi-receptacle device as in claim 1, and further comprising conductors each arranged adjacent the receptacles and configured to be in conductive contact with respective corresponding prongs of the sets of prongs when the prongs are in the first position and out of conductive contact when the prongs are in the second position.

3. A multi-receptacle device as in claim 1, and further comprising a conductor arranged adjacent the receptacles and configured to be in conductive contact with only the first set of prongs, the first and second sets of prongs being insertable in a dual outlet electrical receptacle when they project from the back of the housing, the second set of prongs not being in electrical contact with the first set of prongs and providing support for the device in the dual outlet electrical receptacle.

4. A multi-receptacle device as in claim 1, wherein the first set of prongs projects from the end face of the housing in the second position.

5. A multi-receptacle device as in claim 1, wherein the first set of prongs projects from the end face of the housing in the second position, and the second set of prongs is completely within the housing.

6. A multi-receptacle device, comprising:

a housing having a front face, a back face, an end face and a plurality of receptacles in the front face;

a first set of electrical prongs; and wherein the first set of prongs is pivotally mounted in the housing so as to be movable between a first position in which the prongs project from the back face of the housing and a second position in which the prongs are about 90° to the prongs in the first position, and further comprising an additional set of electrical prongs slideably arranged in the housing so as to be movable between a first position in which the additional set of prongs is completely within the housing and a second position in which the additional set of prongs projects from the end face of the housing, further wherein the two sets of prongs are interconnected so that when the first set is pivoted into the first position projecting from the back face, the additional set is slid into the housing, and when the first set is pivoted into the second position, the additional set is slid to project from the end face.

7. A multi-receptacle device as in claim 6, wherein the housing has a number of holes to facilitate mounting the housing to a wall.

8. A multi-receptacle device as in claim 6, wherein the receptacles are arranged in rows and in at least one of the rows the receptacles are spaced so as to permit transformers to be plugged in.

9. A multi-receptacle device, comprising:

a housing having a front face, a back face, an end face and a plurality of receptacles in the front face;

a first set of electrical prongs; and wherein the first set of prongs is pivotally mounted in the housing so as to be movable between a first position in which the prongs project from the back face of the housing and a second position in which the prongs are about 90° to the prongs in the first position, further comprising a second set of electrical prongs, the second set of prongs being pivotally mounted in the housing so as to be movable between a first position in which the prongs project from the back face of the housing and a second position in which the prongs are about 90° to the prongs in the first position, and further comprising a third set of electrical prongs slideably arranged in the housing so as to be movable between a first position in which the third set of prongs is completely within the housing and a second position in which the third set of prongs projects from the end face of the housing, further wherein the three sets of prongs are interconnected so that when the first and second sets are pivoted into the first position projecting from the back face, the third set is slid into the housing, and when the first and second sets are pivoted into the second position the third set is slid to project from the end face.

10. A multi-receptacle device as in claim 9, and further comprising a slide element connected to one of the first two sets of prongs and movable between a first position and a second position so as to pivot the first two sets of prongs and slide the third set of prongs.

11. A multi-receptacle device as in claim 10, wherein the back face of the housing has two openings that define the first and second positions of the slide element, and further comprising a tension element arranged in the housing so as to urge the slide element into the openings, the slide element being depressable against the tension element so as to be disengageable from and movable between the two openings.

12. A multi-receptacle device as in claim 10, and further comprising a plurality of non-conductive links including a first link arranged to connect the slide element to a prong of the first set of prongs, a second link to connect the prong of the first set of prongs to a prong of the second set of prongs, and a third link to connect the prong of the second set of prongs to a prong of the third set of prongs.

13. A multi-receptacle device as in claim 9, and further comprising conductors each arranged adjacent the receptacles and configured to be in conductive contact with respective corresponding prongs of the first and second sets of prongs and out of conductive contact with the prongs of the third set of prongs when the first, second and third sets of prongs are in the first position, and out of conductive contact with the prongs of the first and second sets and in conductive contact with the prongs of the third set when the first, second and third sets of prongs are in the second position.

14. A multi-receptacle device as in claim 13, wherein a proximal end of a prong of the third set of prongs has a nub that extends toward a corresponding one of the conductors.

15. A multi-receptacle device, comprising:

a housing having a front face, a back face, an end face and a plurality of electrical receptacles in the front face, each receptacle having two power terminals and a third ground terminal;

the receptacles being disposed in three or more rows, a first of the rows having at least one receptacle disposed in a first orientation, a second of the rows having at least one receptacle disposed in a second, different orientation and a third of the rows having the receptacles disposed in a third yet different orientation, the first row being adjacent a first edge of the housing, the ground terminal of the at least one receptacle of the first row being located adjacent the first edge, the third row being adjacent a second edge of the housing parallel to the first edge, the ground terminal of the at least one receptacle of the third row being located adjacent the second edge, and the second row being disposed between the first and third rows.

16. A multi-receptacle device as in claim 15, wherein the first orientation can arbitrarily be defined as 0 degrees, the second orientation is rotated 90 degrees with respect to the first orientation and the third orientation is rotated 180 degrees with respect to the first orientation.

17. An electrical device comprising:

a housing for electrical apparatus; and a first set of electrical prongs; and wherein the first set of prongs is pivotally mounted in the housing so as to be movable between a first position in which the prongs project from the housing and a second position in which the prongs are about 90° to the prongs in the first position, further comprising a second set of prongs, the second set of prongs being pivotally mounted in the housing so as to be movable between a first position in which the prongs project from the housing and a second position in which the prongs are about 90° to the prongs in the first position, the first and second sets of prongs being pivotable about different axes of rotation.

18. An electrical device as in claim 17, and further comprising conductors each arranged adjacent the electrical apparatus and configured to be in conductive contact with respective corresponding prongs of the sets of prongs when the prongs are in the first position and out of conductive contact when the prongs are in the second position.

19. An electrical device as in claim 17, wherein the housing has a number of holes to facilitate mounting the housing to a wall.

20. An electrical device as in claim 17, wherein the first set of prongs projects from the end face of the housing in the second position.

21. An electrical device as in claim 17, wherein the first set of prongs projects from the end face of the housing in the second position, and the second set of prongs is completely within the housing.

22. An electrical device, comprising:

a housing for electrical apparatus; and a first set of electrical prongs; and wherein the first set of prongs is pivotally mounted in the housing so as to be movable between a first position in which the prongs project from the housing and a second position in which the prongs are about 90° to the prongs in the first position, and further comprising an additional set of prongs slideably arranged in the housing so as to be movable between a first position in which the additional set of prongs is completely within the housing and a second position in which the additional set of prongs projects from the end face of the housing, further wherein the two sets of prongs are interconnected so that when the first set is pivoted into the first position projecting from the housing, the additional set is slid into the housing, and when the first set is pivoted into the second position, the additional set is slid to project from the housing.

23. An electrical device comprising:

a housing for electrical apparatus;

a first set of electrical prongs; and wherein the first set of prongs is pivotally mounted in the housing so as to be movable between a first position in which the prongs project from the housing and a second position in which the prongs are about 90° to the prongs in the first position, further comprising a second set of prongs, the second set of prongs being pivotally mounted in the housing so as to be movable between a first position in which the prongs project from the housing and a second position in which the prongs are about 90° to the prongs in the first position, and further comprising a third set of prongs slideably arranged in the housing so as to be movable between a first position in which the third set of prongs is completely within the housing and a second position in which the third set of prongs projects from the housing, further wherein the three sets of prongs are interconnected so that when the first and second sets are pivoted into the first position projecting from the housing, the third set is slid into the housing, and when the first and second sets are pivoted into the second position, the third set is slid to project from the housing, and further wherein the three sets of prongs are interconnected so that when the first and second sets are pivoted into the first position projecting from the housing, the third set is slid into the housing, and when the first and second sets are pivoted into the second position, the third set is slid to project from the housing.

24. An electrical device as in claim 23, and further comprising a slide element connected to one of the first two sets of prongs and movable between a first position and a second position so as to pivot the first two sets of prongs and slide the third set of prongs.

25. An electrical device as in claim 24, wherein the back face of the housing has two openings that define the first and second positions of the slide element, and further comprising a tension element arranged in the housing so as to urge the slide element into the openings, the slide element being depressable against the tension element so as to be disengageable from and movable between the two openings.

26. An electrical device as in claim 24, and further comprising a plurality of non-conductive links including a first link arranged to connect the slide element to a prong of the first set of prongs, a second link to connect the prong of the first set of prongs to a prong of the second set of prongs, and a third link to connect the prong of the second set of prongs to a prong of the third set of prongs.

27. An electrical device as in claim 23, and further comprising conductors each arranged adjacent the electrical apparatus and configured to be in conductive contact with respective corresponding prongs of the first and second sets of prongs and out of conductive contact with the prongs of the third set of prongs when the first, second and third sets of prongs are in the first position, and out of conductive contact with the prongs of the first and second sets and in conductive contact with the prongs of the third set when the first, second and third sets of prongs are in the second position.

28. An electrical device as in claim 27, wherein a proximal end of a prong of the third set of prongs has a nub that extends toward a corresponding one of the conductors.

* * * * *